US007530547B2

(12) United States Patent
Leitner et al.

(10) Patent No.: US 7,530,547 B2
(45) Date of Patent: May 12, 2009

(54) CABLE WINCH ARRANGEMENT

(75) Inventors: Karl Leitner, Sterzing (IT); Martin Runggaldier, St. Christina (IT)

(73) Assignee: Prinoth A.G., Sterzing (IT)

( * ) Notice: Subject to any disclaimer, the term of this patent is extended or adjusted under 35 U.S.C. 154(b) by 435 days.

(21) Appl. No.: 11/143,497

(22) Filed: Jun. 3, 2005

(65) Prior Publication Data

US 2005/0279980 A1 Dec. 22, 2005

(30) Foreign Application Priority Data

Jun. 4, 2004 (AT) ..... A 968/2004

(51) Int. Cl.
*B66D 1/00* (2006.01)

(52) U.S. Cl. ..... 254/323; 254/332; 254/335

(58) Field of Classification Search ..... 254/323, 254/332, 334, 335
See application file for complete search history.

(56) References Cited

U.S. PATENT DOCUMENTS

| | | | | | |
|---|---|---|---|---|---|
| 3,104,015 | A * | 9/1963 | Goldfarb | ..... | 212/241 |
| 3,692,119 | A * | 9/1972 | Tucker | ..... | 172/23 |
| 3,926,316 | A * | 12/1975 | Luttrell | ..... | 212/259 |
| 4,789,072 | A * | 12/1988 | Quam et al. | ..... | 212/166 |
| 5,035,336 | A * | 7/1991 | Schmitz et al. | ..... | 212/166 |
| 5,505,578 | A * | 4/1996 | Fuller | ..... | 414/427 |
| 6,945,742 | B2 * | 9/2005 | Roberts | ..... | 414/449 |
| 2003/0235487 | A1 * | 12/2003 | Roberts | ..... | 414/490 |

FOREIGN PATENT DOCUMENTS

| | | |
|---|---|---|
| DE | 1 226 056 | 5/1967 |
| DE | 1 944 944 | 3/1971 |
| DE | 10 2004 025 973 | 10/2006 |
| EP | 0 761 890 A1 | 3/1997 |
| EP | 1 331 198 A1 | 7/2003 |

* cited by examiner

*Primary Examiner*—Emmanuel M Marcelo
(74) *Attorney, Agent, or Firm*—Wenderoth, Lind & Ponack, L.L.P.

(57) ABSTRACT

A cable winch arrangement for a vehicle (1), particularly for a piste preparation vehicle (1), includes a cable winch (2) and a cable (3), and includes a coupling device (4), disposed on the cable (3), for coupling to and decoupling from an external anchorage point (5), with the arrangement having a means for remote-controlled coupling and/or decoupling of the coupling device (4).

27 Claims, 4 Drawing Sheets

CABLE WINCH ARRANGEMENT

FIELD OF THE INVENTION

The present invention relates to a cable winch arrangement for a vehicle, particularly for a piste preparation vehicle, the cable winch arrangement comprising a cable winch and a cable, and comprising a coupling device, disposed on the cable, for coupling to and decoupling from an external anchorage point. The invention additionally relates to a vehicle comprising such a cable winch arrangement.

DESCRIPTION OF RELATED ART

Such cable winch arrangements are already known from the prior art and are used, in particular, for the preparation of steep slopes on pistes. In the case of these arrangements, a cable drum anchored on the piste vehicle is used to accommodate the steel winch cable, and for winding-up and unwinding the latter. In the preparation of very steep terrain, the cable is first secured to an anchorage point provided for this purpose in an upper end region of the piste, enabling the piste vehicle to move uphill using the cable winch. Consequently, on the one hand the piste vehicle is secured in its position in respect of unwanted downward slippage and, on the other hand, the winch enables substantially greater quantities of snow to be dealt with, which, in turn, is reflected in greater time efficiency. In the case of the prior art, attaching of the cable to the anchorage point is performed manually, i.e., the driver has to get out of his vehicle and, using the coupling device, attach the leading edge of the cable to the anchorage point provided. Since the cable together with the coupling element is of a substantial weight, there are high physical demands on the driver. Moreover, upon getting out of the vehicle, the driver is sometimes confronted with hazardous conditions such as, for example, steepness of the terrain, piste conditions (large quantities of snow or icy piste surface), which render manual attachment more difficult.

The object of the present invention, therefore, is to propose a cable winch arrangement of the type mentioned at the outset which obviates the aforementioned disadvantages of the prior art.

SUMMARY OF THE INVENTION

This is achieved, according to the invention, in that the arrangement has a means for remote-controlled coupling and/or decoupling of the coupling device.

The means according to the invention permits automated connection of the cable coupling device to the external anchorage point without the driver having to get out of his vehicle. Manual attachment or coupling to the anchorage point thus becomes unnecessary. The driver's work is thereby substantially facilitated, and coupling and decoupling are performed in a rapid, uncomplicated manner. "Remote-controlled coupling and/or decoupling" is understood to include, in particular, all those measures which enable the coupling device to be coupled to and decoupled from the anchorage point from the vehicle, preferably from the driver's cab, without the need to attach and detach the cable by hand.

A preferred embodiment of the invention makes provision whereby the cable winch arrangement has a winch arm through which or on which the cable can be guided, the winch arm preferably being movable through the means for remote-controlled coupling and/or decoupling. This means enables the winch arm to be remotely actuated and to be controlled without restriction of movement. In addition to the advantage of greater mobility, this also results in a saving of time. In this case the winch arm itself can be operated hydraulically and, furthermore, permits rotation and pivoting through 360° and lateral tilting.

A provision is made, particularly advantageously, whereby the winch arm has at least one arm, preferably at least one telescopically movable boom, which can be moved relative to the winch arm and by means of which the coupling device can at least be brought closer to the external anchorage point. In this case, the movable arm, or the telescopically movable boom, can also be pivotally disposed on the winch arm. The vehicle can then be positioned at a distance from the anchorage point since, due to the contour and condition of the terrain, it is not always possible to drive very close to the anchorage point. In connection with this, a provision may advantageously be made whereby the coupling device has at least one magnet by means of which the coupling device can be coupled to the external anchorage point.

In principle, however, there are several possibilities for realization of the coupling device. A provision may advantageously be made whereby the at least one magnet is an electromagnet which can be activated through the means for remote-controlled coupling and/or decoupling. In this case, a provision may advantageously be made whereby the coupling device comprises a sensor device, preferably a contact sensor, through which the electromagnet can be activated. The electromagnet is then supplied with electric power through the means according to the invention, and thereby causes the magnet to adhere to a location provided for this purpose on the anchorage point. A further advantageous variant of the invention makes a provision whereby the coupling device has a fastening element, preferably a hook-shaped device, which can be coupled to the external anchorage point. In this case, a hook, for example, can easily be attached—as known per se—to a ring-type device. A provision may advantageously be made whereby the coupling device comprises a, preferably hydraulic, locking means, through which it can be fixed to the external anchorage point. A provision is advantageously made whereby the locking means can be activated through the means for remote-controlled coupling and/or decoupling. This locking means may be realized with a hydraulically operated locking bolt, which cooperates with a corresponding device on the external anchorage point. The locking means may obviously be electrically operated. An advantageous embodiment of the invention makes provision whereby the coupling element comprises a, preferably substantially spherical, body which is provided to be accommodated in a retaining device disposed or realized on the external anchorage point. A provision may be made, in this case, whereby the external anchorage point has a pocket-type retaining device in which the substantially spherical body can be inserted. According to a development of the invention, a provision may be made whereby the pocket-type retaining device comprises a metal plate which is raised at two corners. The spherical body can then be accommodated in the resulting cavity.

A further embodiment of the invention makes a provision whereby the means for remote-controlled coupling and/or decoupling can be activated from within the vehicle. In this case, the driver of the vehicle can remain in the driver's cab and control the coupling operation with a clear view. Obviously, a provision may also be made whereby the means for remote-controlled coupling and/or decoupling comprises a wireless transmission means. For example, a radio remote control or infrared remote control may be used for this. It is thereby possible for the driver to take up a position at a favourable location at which he can control the attachment operation in a purposive manner.

According to a further variant of the invention, an inverse solution may also be provided. In concrete terms, this means that the external anchorage point may have a remote-controlled, detachable retaining device. This can be realized by a magnet, preferably an electromagnet, provided for coupling to and/or decoupling from the coupling device. A provision can also be made in this case whereby the external anchorage point has a sensor device, preferably a contact sensor, through which the electromagnet can be activated. The external anchorage point may also advantageously have an electric locking means through which the coupling device can be coupled and/or decoupled, electric power being supplied via the anchorage point. This has advantages in respect of construction engineering, since the electric power supply can be taken, for example, from the terminal boxes of snow generators. In this case, a provision may advantageously be made whereby the electric locking device can be activated through the means for remote-controlled coupling and/or decoupling. The external anchorage point may in this case have a wireless transmission means through which the electromagnet and/or the electric locking means can be activated. This wireless transmission means may be realized by, for example, a conventional radio link or an infrared transmitting/receiving unit.

The vehicle according to the invention is characterized by a cable winch arrangement, according to the attached claims, as described above.

BRIEF DESCRIPTION OF THE DRAWINGS

Further details and advantages of the present invention are explained more fully in the following on the basis of the description of the figures with reference to the drawings, wherein.

DETAILED DESCRIPTION OF PREFERRED EMBODIMENTS

Figure 1:
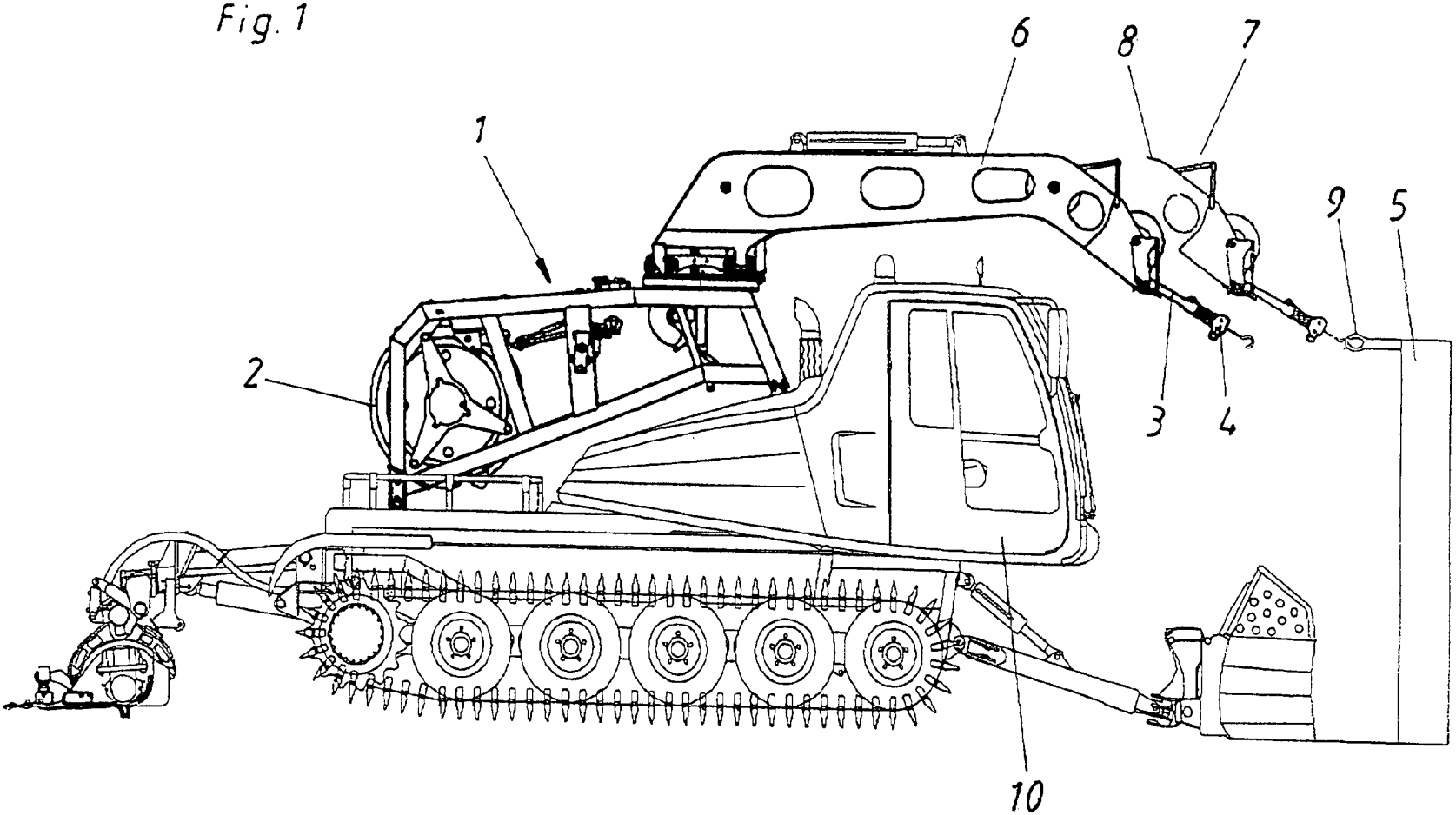
FIG. 1 shows a schematically represented piste preparation vehicle comprising a cable winch arrangement according to the present invention.

FIG. 1 shows a first schematically represented exemplary embodiment of the present invention, which represents a piste preparation vehicle 1 on which a cable drum 2 is attached. This cable drum 2 serves to accommodate, and to wind up and unwind, a cable 3, at the end of which a coupling device 4 is disposed. In the preparation of steep slopes, this cable 3 is fastened, by means of its coupling device 4, to an external anchorage point 5, so that the piste preparation vehicle 1 is secured in respect of unwanted slippage during ascending or descending of the piste. The cable 3 is in this case routed in or on a winch arm 6, which is mounted on the piste preparation vehicle 1 so as to be capable of swiveling and to be adjustable in respect of inclination and height. The means, according to the invention, for remote-controlled coupling and/or decoupling enables the coupling device 4 to be displaced in the manner shown in the detail 7. In the figure shown, the winch arm 6 has an arm 8 which can be moved relative to it and which can be realized in the form of a telescopic boom. This arm 8 can be moved by the means for remote-controlled coupling and/or decoupling such that the coupling device 4 can be guided to the exemplarily represented retaining device 9 in the form of a ring of the external anchorage point 5. In the figure shown, the coupling device 4 and the retaining device 9 are represented in simplified form for reasons of clarity. The coupling device 4 may also have an electromagnet which can be activated through the means for remote-controlled coupling and/or decoupling. Activation may advantageously be effected by means of a contact sensor, the electromagnet being supplied with electric power, causing it to adhere, upon contact between the coupling device 4 and the retaining device 9 of the external anchorage point 5. The contact sensor may also cooperate with a locking means which fixes the coupling device 4 to the retaining device 9, for example by means of a hydraulically operated sliding bolt. The means for remote-controlled coupling and/or decoupling may advantageously be capable of being activated or actuated from within the piste preparation vehicle 1, the driver being able to remain in the driver's cab 10. A provision may be made, as an option or supplement to the latter provision, whereby the means according to the invention is also realized as a wireless transmission means, for example in the form of a radio transmitting/receiving unit or infrared transmitting/receiving unit. The driver is then able to control the coupling operation at a suitable location, for example by means of a remote control.

Figure 2:
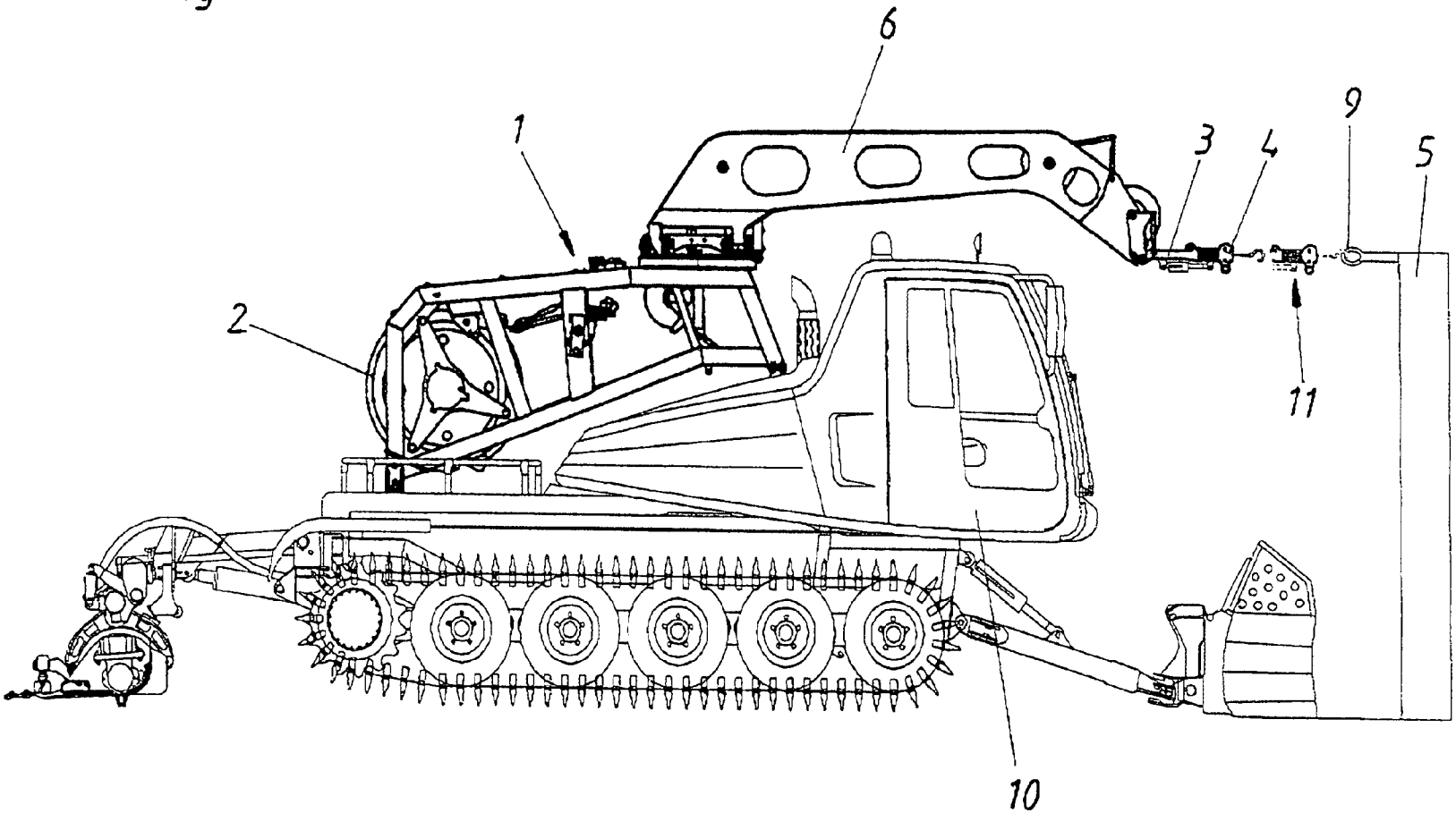
FIG. 2 shows a further exemplary embodiment of the invention.

FIG. 2 shows a variant of the invention wherein at least one telescopically movable boom 11 is disposed on the winch arm 6. This boom 11 can be of such design that it is mounted so as to be adjustable in respect of height, length and angle of inclination. It is thereby possible to propose a solution, which is simple in respect of construction engineering, for the automated coupling of the coupling device 4 to the retaining element 9 of the external anchorage element 5. The telescopically movable boom 11 can be guided to the retaining element 9 by the means for remote-controlled coupling and/or decoupling such that coupling is rendered possible without manual intervention.

Figure 3:
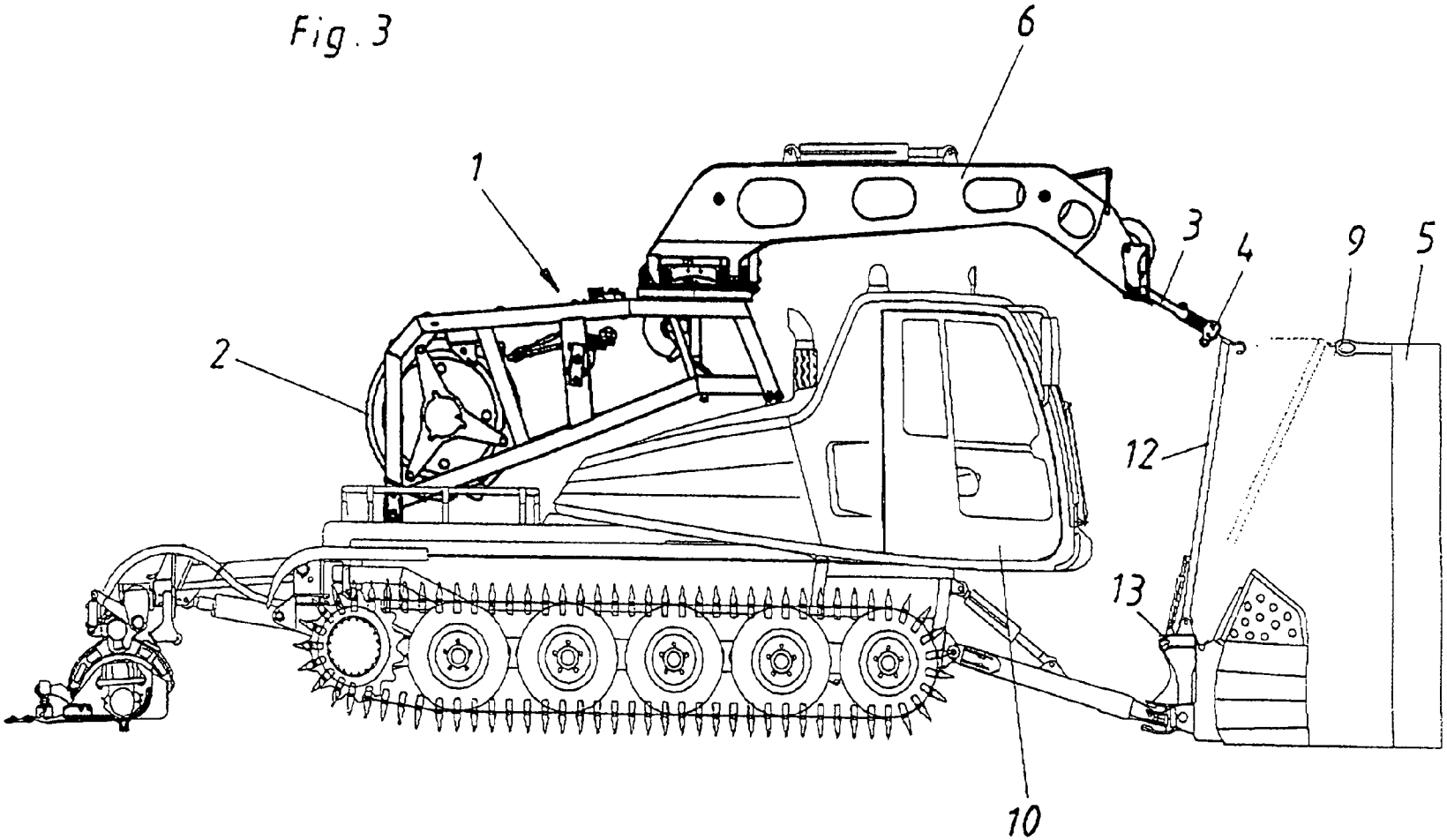
FIG. 3 shows a piste preparation vehicle comprising a cable winch arrangement in a further embodiment.

FIG. 3 shows a further schematically represented exemplary embodiment of the present invention. In the figure shown, the coupling device 4 can be brought, by means of an accessory arm 12, to the retaining device 9 of the external anchorage point 5. The accessory arm 12 in this case can be of such design that it likewise is mounted so as to be adjustable in respect of height, length and angle in relation to the blade frame 13.

Figure 4:
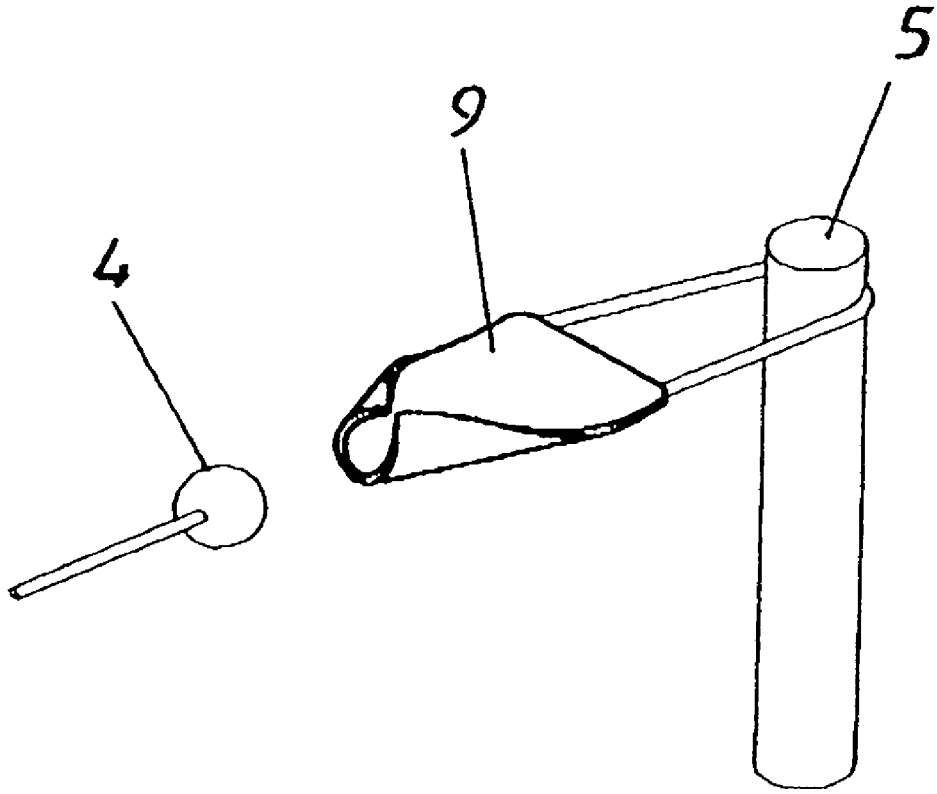
FIG. 4 shows a schematically represented detail of a coupling device, with a retaining element of an anchorage point.

FIG. 4 shows a schematically represented exemplary embodiment for the realization of a detachable connection between the coupling device 4 and the retaining device 9 of the external anchorage point 5. In the figure shown, the coupling device 4 has a spherical body which is provided to be accommodated in the retaining device 9. In the figure shown, the retaining device 9 comprises a metal plate, the corners of which have been raised at the end that faces the coupling device. A cavity is thereby produced which tapers towards the coupling device 9. The spherical body is inserted in the retaining device 9, so that the piste preparation vehicle 1, coupled to this connection, can travel on the steep slope.

It is self-evident that the cable winch arrangement according to the invention is neither restricted to the exemplary embodiments represented in the figures nor to be limited by these exemplary embodiments. There are numerous variants for the coupling of the retaining device 9 to the external anchorage point 5, which may comprise both positive and non-positive (in particular, frictional) connection measures.

The invention claimed is:

1. A piste preparation vehicle comprising:

a cable winch arrangement including a cable winch and a cable; and a coupling device, disposed on the cable, for coupling to and decoupling from a fixed external anchorage point, wherein the cable winch arrangement has a means for at least one of remote-controlled coupling and remote-controlled decoupling of the coupling device, wherein the cable winch arrangement has a winch arm through which or on which the cable is arranged to be guided, the winch arm having at least one arm which is configured to be moved relative to the winch arm and by means of which the coupling device is arranged to at least be brought closer to the external anchorage point, and wherein the at least one arm comprises a telescopically movable boom.

2. A piste preparation vehicle according to claim 1, wherein the winch arm is movable through the means for at least one of remote-controlled coupling and remote-controlled decoupling.

3. A piste preparation vehicle according to claim 1, wherein the coupling device has at least one magnet by means of which the coupling device is arranged to be coupled to the external anchorage point.

4. A piste preparation vehicle according to claim 3, wherein the at least one magnet is an electromagnet which is configured to be activated through the means for at least one of remote-controlled coupling and remote-controlled decoupling.

5. A piste preparation vehicle according to claim 4, wherein the coupling device comprises a sensor device through which the electromagnet is configured to be activated.

6. A piste preparation vehicle according to claim 5, wherein the sensor device comprises a contact sensor.

7. A piste preparation vehicle according to claim 1, wherein the coupling device has a fastening element which is arranged to be coupled to the external anchorage point.

8. A piste preparation vehicle according to claim 7, wherein the fastening element comprises a hook-shaped device.

9. A piste preparation vehicle according to claim 1, wherein the coupling device comprises a locking means, through which the coupling device is configured to be fixed to the external anchorage point.

10. A piste preparation vehicle according to claim 9, wherein the locking means is configured to be activated through the means for at least one of remote-controlled coupling and remote-controlled decoupling.

11. A piste preparation vehicle according to claim 1, wherein the coupling device comprises a substantially spherical body which is provided to be accommodated in a retaining device disposed or realized on the external anchorage point.

12. A piste preparation vehicle according to claim 11, wherein the substantially spherical body is configured to be inserted in a pocket-type retaining device of the external anchorage point.

13. A piste preparation vehicle according to claim 12, wherein the pocket-type retaining device comprises a metal plate which is raised at two corners.

14. A piste preparation vehicle according to claim 1, wherein the means for at least one of remote-controlled coupling and remote-controlled decoupling is configured to be activated from within the vehicle.

15. A piste preparation vehicle according to claim 1, wherein the means for at least one of remote-controlled coupling and remote-controlled decoupling comprises a wireless transmission means.

16. A piste preparation vehicle according to claim 1, wherein the external anchorage point has a remote-controlled, detachable retaining device.

17. A piste preparation vehicle according to claim 1, wherein the coupling device is configured to be at least one of coupled to and decoupled from a magnet of the external anchorage point.

18. A piste preparation vehicle according to claim 17, wherein the magnet is an electromagnet.

19. A piste preparation vehicle according to claim 18, wherein the electromagnet is configured to be activated through a wireless transmission means of the external anchorage point.

20. A piste preparation vehicle according to claim 18, wherein the electromagnet is configured to be activated through a sensor device of the external anchorage point.

21. A piste preparation vehicle according to claim 20, wherein the sensor device comprises a contact sensor.

22. A piste preparation vehicle according to claim 1, wherein the coupling device is configured to be coupled through an electric locking device of the external anchorage point.

23. A piste preparation vehicle according to claim 22, wherein the electric locking device is configured to be activated through the means for at least one of remote-controlled coupling and remote-controlled decoupling.

24. A piste preparation vehicle according to claim 1, wherein the coupling device is configured to be decoupled through an electric locking device of the external anchorage point.

25. A piste preparation vehicle according to claim 24, wherein the electric locking device is configured to be activated through the means for at least one of remote-controlled coupling and remote-controlled decoupling.

26. A piste preparation vehicle according to claim 24, wherein the electric locking device is configured to be activated through a wireless transmission means of the external anchorage point.

27. A combination of a piste preparation vehicle and a fixed external anchorage point, wherein the piste preparation vehicle includes a cable winch arrangement having a cable winch and a cable, wherein the piste preparation vehicle also includes a coupling device, disposed on the cable, for coupling to and decoupling from the fixed external anchorage point, and wherein the cable winch arrangement has a means for at least one of remote-controlled coupling and remote-controlled decoupling of the coupling device.

* * * * *